US009897321B2

(12) United States Patent
Prociw

(10) Patent No.: US 9,897,321 B2
(45) Date of Patent: Feb. 20, 2018

(54) FUEL NOZZLES

(71) Applicant: Delavan Inc, West Des Moines, IA (US)

(72) Inventor: Lev Alexander Prociw, Johnston, IA (US)

(73) Assignee: Delavan Inc., West Des Moines, IA (US)

( * ) Notice: Subject to any disclaimer, the term of this patent is extended or adjusted under 35 U.S.C. 154(b) by 283 days.

(21) Appl. No.: 14/674,580

(22) Filed: Mar. 31, 2015

(65) Prior Publication Data

US 2016/0290649 A1 Oct. 6, 2016

(51) Int. Cl.

| | |
|---|---|
| ***F23R 3/28*** | (2006.01) |
| ***F23R 3/14*** | (2006.01) |
| ***F23R 3/34*** | (2006.01) |
| ***F23D 11/10*** | (2006.01) |
| ***F23D 11/38*** | (2006.01) |
| *F23C 7/00* | (2006.01) |
| *F23R 3/12* | (2006.01) |

(52) U.S. Cl.

CPC ..... *F23R 3/286* (2013.01); *F23D 11/107* (2013.01); *F23D 11/383* (2013.01); *F23R 3/14* (2013.01); *F23R 3/28* (2013.01); *F23R 3/346* (2013.01); *F23C 7/002* (2013.01); *F23C 7/004* (2013.01); *F23R 3/12* (2013.01); *F23R 3/283* (2013.01)

(58) Field of Classification Search

CPC .... F23R 3/286; F23R 3/12; F23R 3/14; F23R 3/28; F23R 3/283; F23C 7/002; F23C 7/004

See application file for complete search history.

(56) References Cited

U.S. PATENT DOCUMENTS

| | | | |
|---|---|---|---|
| 1,875,457 | A | 9/1932 | Hemmingsen |
| 2,607,193 | A | 8/1952 | Berggren et al. |
| 3,680,793 | A | 8/1972 | Tate et al. |
| 3,912,164 | A | 10/1975 | Lefebvre et al. |
| 3,937,011 | A | 2/1976 | Caruel et al. |

(Continued)

FOREIGN PATENT DOCUMENTS

| | | | |
|---|---|---|---|
| BE | 488386 | A | 4/1949 |
| EP | 0689007 | A1 | 12/1995 |

(Continued)

OTHER PUBLICATIONS

U.S. Appl. No. 14/674,709, filed Mar. 31, 2015.

(Continued)

*Primary Examiner* — Pascal M Bui Pho
*Assistant Examiner* — Katheryn Malatek
(74) *Attorney, Agent, or Firm* — Locke Lord LLP; Scott D. Wofsy; Alicia J. Carroll

(57) ABSTRACT

A nozzle includes a nozzle body defining a longitudinal axis. The nozzle body includes an air passage having a radial swirler and a converging conical cross-section. A fuel circuit is radially outboard from the air passage with respect to the longitudinal axis. The fuel circuit extends from a fuel circuit inlet to a fuel circuit annular outlet. The fuel circuit includes a plurality of helical passages to mitigate gravitational effects at low fuel flow rates. Each helical passage of the fuel circuit opens tangentially with respect to the fuel circuit annular outlet into an outlet of the air passage.

15 Claims, 4 Drawing Sheets

(56) References Cited

U.S. PATENT DOCUMENTS

| | | | | |
|---|---|---|---|---|
| 3,980,233 | A | 9/1976 | Simmons et al. | |
| 4,598,553 | A | 7/1986 | Saito et al. | |
| 4,653,278 | A | 3/1987 | Vinson et al. | |
| 5,409,169 | A | 4/1995 | Saikalis et al. | |
| 5,713,206 | A | 2/1998 | McWhirter et al. | |
| 5,860,600 | A | 1/1999 | Schindler et al. | |
| 6,003,781 | A | 12/1999 | Kwan | |
| 6,092,363 | A | 7/2000 | Ryan | |
| 6,247,317 | B1 | 6/2001 | Kostka | |
| 6,360,525 | B1 | 3/2002 | Senior et al. | |
| 6,363,726 | B1 | 4/2002 | Durbin et al. | |
| 6,533,954 | B2 | 3/2003 | Mansour et al. | |
| 6,622,488 | B2 | 9/2003 | Mansour et al. | |
| 6,688,534 | B2 | 2/2004 | Bretz | |
| 6,755,024 | B1 | 6/2004 | Mao et al. | |
| 6,775,984 | B2 | 8/2004 | Lavie et al. | |
| 6,854,670 | B2 | 2/2005 | Sumisha et al. | |
| 6,863,228 | B2 | 3/2005 | Mao et al. | |
| 7,454,914 | B2 | 11/2008 | Prociw | |
| 7,509,811 | B2 | 3/2009 | Chen et al. | |
| 7,520,134 | B2 | 4/2009 | Durbin et al. | |
| 7,533,531 | B2 | 5/2009 | Prociw et al. | |
| 7,654,088 | B2 | 2/2010 | Shafique et al. | |
| 7,891,193 | B2 * | 2/2011 | Hernandez | F23D 11/36 239/132.5 |
| 7,926,178 | B2 | 4/2011 | Thomson et al. | |
| 7,926,282 | B2 | 4/2011 | Chew et al. | |
| 8,015,796 | B2 | 9/2011 | Babu et al. | |
| 8,074,452 | B2 | 12/2011 | Prociw et al. | |
| 8,171,735 | B2 | 5/2012 | Mancini et al. | |
| 8,186,163 | B2 | 5/2012 | Hernandez et al. | |
| 8,347,630 | B2 | 1/2013 | Lovett et al. | |
| 8,733,105 | B2 | 5/2014 | Toon | |
| 2002/0134084 | A1 | 9/2002 | Mansour et al. | |
| 2005/0039456 | A1 | 2/2005 | Hayashi | |
| 2005/0133642 | A1 | 6/2005 | Rackwitz | |
| 2005/0279862 | A1 | 12/2005 | Mao et al. | |
| 2007/0101727 | A1 * | 5/2007 | Prociw | F23D 11/105 60/776 |
| 2008/0236165 | A1 | 10/2008 | Baudoin et al. | |
| 2009/0050710 | A1 | 2/2009 | Myers et al. | |
| 2009/0111063 | A1 | 4/2009 | Boardman et al. | |
| 2009/0224080 | A1 | 9/2009 | Chew et al. | |
| 2009/0255258 | A1 | 10/2009 | Bretz et al. | |
| 2010/0050644 | A1 | 3/2010 | Pidcock et al. | |
| 2011/0031333 | A1 | 2/2011 | Short | |
| 2012/0039761 | A1 | 2/2012 | Sprouse et al. | |
| 2012/0186259 | A1 | 7/2012 | Hoke | |
| 2012/0228397 | A1 | 9/2012 | Thomson | |
| 2012/0234013 | A1 * | 9/2012 | Overman | F23C 9/006 60/772 |
| 2014/0090382 | A1 | 4/2014 | Sandelis et al. | |
| 2014/0318137 | A1 | 10/2014 | McMasters et al. | |
| 2014/0332602 | A1 | 11/2014 | Cramb et al. | |
| 2014/0339339 | A1 | 11/2014 | Prociw | |

FOREIGN PATENT DOCUMENTS

| | | | |
|---|---|---|---|
| EP | 1526332 | A2 | 4/2005 |
| EP | 2497922 | A2 | 9/2012 |
| EP | 2500641 | A1 | 9/2012 |
| EP | 2589866 | A2 | 5/2013 |
| EP | 2775202 | A2 | 9/2014 |
| GB | 2131154 | A | 6/1984 |
| GB | 2459041 | A | 10/2009 |
| GB | 2459771 | A | 11/2009 |
| JP | 2005061715 | A | 3/2005 |
| WO | WO-1989/05195 | A1 | 6/1989 |
| WO | WO-2005061964 | A1 | 7/2005 |
| WO | WO-2014011405 | A1 | 1/2014 |

OTHER PUBLICATIONS

Extended European Search Report dated Aug. 17,2016, issued during the prosecution of European Patent Application No. 16163374.8 (4 pages).

Extended European Search Report dated Aug. 8, 2016, issued during the prosecution of European Patent Application No. EP 16163366.4 (8 pages).

International Search Report for PCT Application No. PCT/US2013/048201 dated Sep. 25, 2013.

R. Tacina et al., "Experimental Investigation of a Multiplex Fuel Injector Module with Discrete Jet Swirlers for Low Emission Combustors", NASA/TM-2004-212918; AIAA-2014-0185 (2004).

C. Lee et al., "High Pressure Low Nox Emissions Research: Recent Progress at NASA Glenn Research Center",ISABE-2007-1270 (2007).

K. M. Tacina et al., NASA Glenn High Pressure Low NOX Emissions Research:, NASA/TM-2008-214974 (2008).

Extended European Search Report dated Dec. 22, 2016 issued during the prosecution of European Patent Application No. EP 12191139.0 (9 pages).

* cited by examiner

Fig. 1
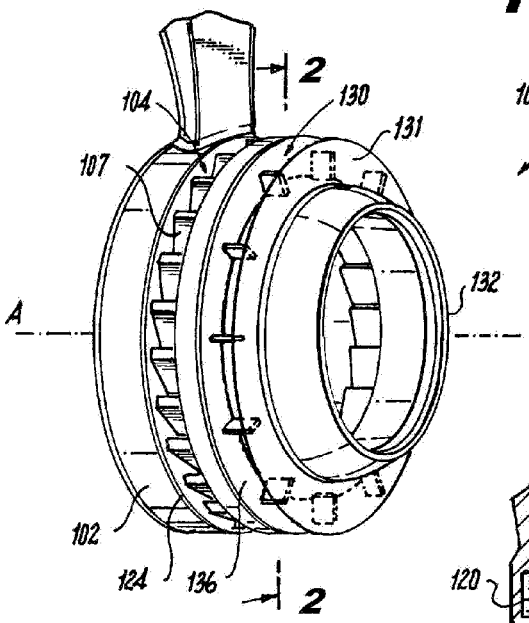
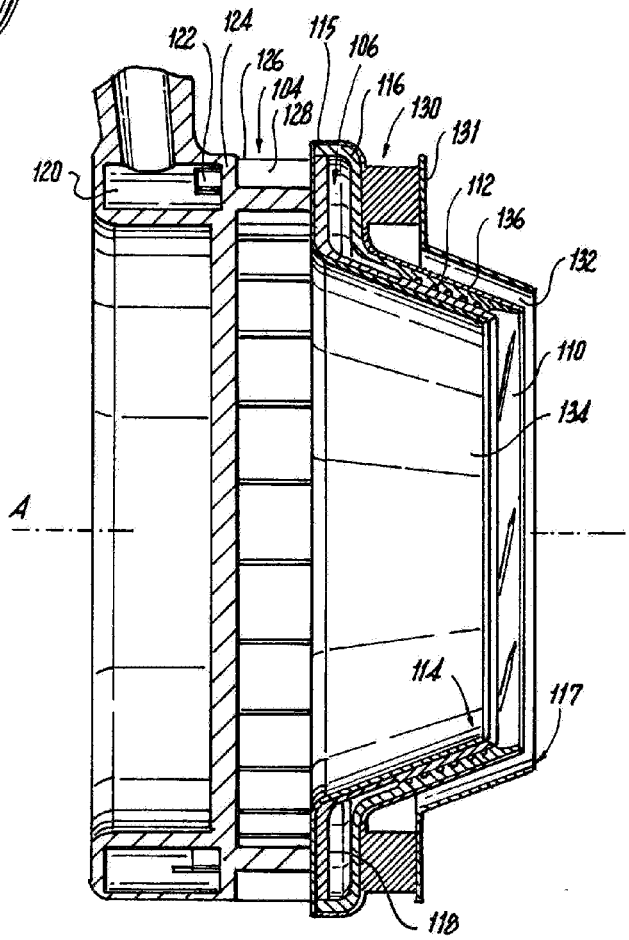
Fig. 2

FUEL NOZZLES

BACKGROUND OF THE INVENTION

1. Field of the Invention

The present disclosure relates to nozzles, and more particularly to fuel nozzles such as those used in combustors of gas turbine engines.

2. Description of Related Art

A variety of engines typically incorporate fuel injectors or nozzles in their combustion sections in which fuel and air are mixed and combusted. Efficiency of combustion is related to a variety of factors including fuel-to-air ratio, ignition source location and degree of fuel atomization. Fuel is typically sprayed from a pressure atomizer and then mixed with flows of air.

Such conventional methods and systems have generally been considered satisfactory for their intended purpose. However, there is an ongoing need in the art for improved fuel nozzles. The present disclosure provides a solution for this need.

SUMMARY OF THE INVENTION

A nozzle includes a nozzle body defining a longitudinal axis. The nozzle body includes an air passage having a radial swirler and a converging conical cross-section. A fuel circuit is radially outboard from the air passage with respect to the longitudinal axis. The fuel circuit extends from a fuel circuit inlet to a fuel circuit annular outlet. The fuel circuit includes a plurality of helical passages to mitigate gravitational effects at low fuel flow rates. Each helical passage of the fuel circuit opens tangentially with respect to the fuel circuit annular outlet into an outlet of the air passage.

In accordance with certain embodiments, the helical passages are defined by helical threads in at least one of a fuel circuit inner wall or a fuel circuit outer wall. Each helical passage can intersect a single cross-sectional plane taken along the longitudinal axis. More than one of the helical passages can intersect each cross-sectional plane taken along the longitudinal axis. Each of the helical passages can complete at least one 360 degree pass through the fuel circuit.

The fuel circuit annular outlet can be proximate to the outlet of the air passage. The fuel circuit can be defined between a fuel circuit inner wall and a fuel circuit outer wall. At least a portion of the fuel circuit outer wall can be radially outboard from the fuel circuit inner wall with respect to the longitudinal axis. At least a portion of both the fuel circuit inner wall and outer wall can be conical shapes that converge toward the longitudinal axis. The fuel circuit inlet can include a plurality of circumferentially spaced apart openings in fluid communication with a fuel manifold. A plurality of tubes can be defined through the air passage, each tube connecting the openings to the fuel manifold.

It is contemplated that the air passage can be defined between a backing plate and a fuel circuit inner wall downstream from the backing plate. At least a portion of the fuel circuit inner wall can be a conical shape that converges toward the longitudinal axis. The air passage can include an annular inlet. The radial swirler can include radial swirl vanes circumferentially spaced apart from one another about the annular inlet to induce swirl into air entering the annular inlet of the air passage. The tubes are defined within the radial swirl vanes.

An outer air passage can be defined radially outboard of the fuel circuit with respect to the longitudinal axis. The outer air passage can be defined between a fuel circuit outer wall and an outer air passage wall. The outer air passage can be a converging non-swirling outer air passage. An annular outlet of the outer air passage can be proximate to the fuel circuit annular outlet. The nozzle body can include an insulation jacket between the air passage and the fuel circuit and/or between the outer air passage and the fuel circuit. The nozzle can include a low-flow fuel nozzle integrated into a backing plate of the nozzle body upstream from the air passage.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 is a perspective view of an exemplary embodiment of a nozzle constructed in accordance with the present disclosure, showing the swirling air passage and the non-swirling outer air passage;

FIG. 2 is a cross-sectional side elevation view of the nozzle of FIG. 1, showing the corresponding cross-section indicated in FIG. 1;

DETAILED DESCRIPTION OF THE PREFERRED EMBODIMENTS

Figure 3:
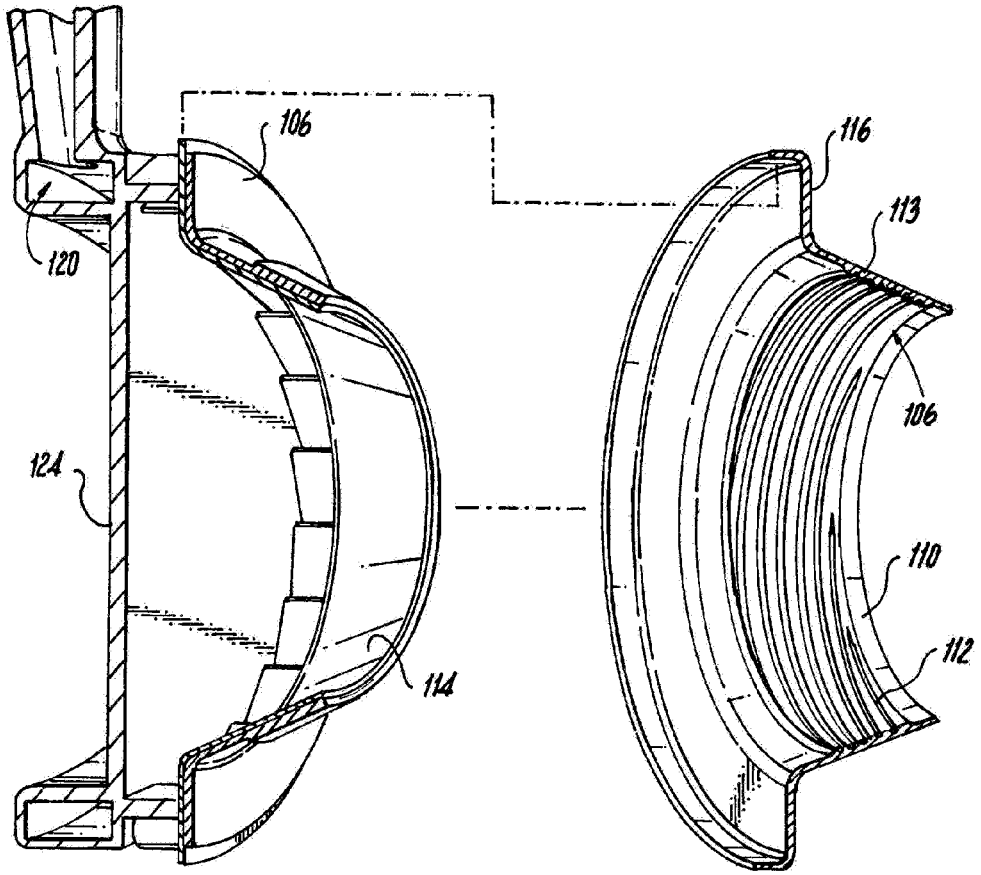
FIG. 3 is an exploded cross-sectional perspective view of a portion of the nozzle of FIG. 1, showing the helical passages of the fuel circuit.

Reference will now be made to the drawings wherein like reference numerals identify similar structural features or aspects of the subject disclosure. For purposes of explanation and illustration, and not limitation, a partial view of an exemplary embodiment of a nozzle in accordance with the disclosure is shown in FIG. 1 and is designated generally by reference character 100. Other embodiments of nozzles in accordance with the disclosure, or aspects thereof, are provided in FIGS. 2-6B, as will be described. The systems and methods described herein provide for radial swirl nozzles with reduced emissions and improved temperature uniformity over traditional radial swirl nozzles.

As shown in FIGS. 1 and 2, a nozzle 100 includes a nozzle body 102 defining a longitudinal axis A. Nozzle body 102 includes a fuel circuit 106 radially outboard from an air passage 104 with respect to longitudinal axis A. Fuel circuit 106 is defined between a fuel circuit inner wall 115 and a fuel circuit outer wall 116. It is contemplated that inner and outer fuel circuit walls 115 and 116, respectively, can be made from a metallic material. A portion of fuel circuit outer wall 116 is radially outboard from fuel circuit inner wall 115 with respect to longitudinal axis A. A portion of both the fuel circuit inner wall 115 and outer wall 116 are conically shaped and converge toward longitudinal axis A. Fuel circuit annular outlet 110 is proximate to the outlet of air passage 104.

With continued reference to FIGS. 1 and 2, air passage 104 is defined between a backing plate 124 and a jacket 134 downstream from backing plate 124. Those skilled in the art will readily appreciate that backing plate 124 and jacket 134 can be made from thin metallic materials and/or a thicker ceramic material, such as a ceramic-matrix composite (CMC) material, e.g. jacket 134 can be an insulation jacket. Air passage 104 includes a radial swirler 107 at an annular inlet 126. Radial swirler 107 has radial swirl vanes 128 circumferentially spaced apart from one another about annular inlet 126 to induce swirl into air entering air passage 104. Large swirl offset and pure radial entry produces very high swirl and high radial pressure gradient at fuel outlet 110.

As shown in FIG. 2, an outer air passage 130 is defined radially outboard of fuel circuit 106 with respect to longitudinal axis A. Outer air passage 130 provides non-swirled air. Outer air passage 130 is between a jacket 136 and an outer air passage wall 131. It is contemplated jacket 136 and an outer air passage wall 131 can be constructed using a thin metallic material and/or thicker ceramic material, e.g. a CMC material. For example, jacket 136 can be a metallic shell and not provide any insulation and/or it can be a ceramic material and be an insulation jacket to insulate fuel circuit 106. Insulation jackets can be made from a ceramic or a ceramic composite material, both of which tend to reduce thermal growth mismatch. Metallic shells can be designed to mitigate thermal growth effects, e.g. by using slits, multiple pieces, growth gaps etc.

In accordance with some embodiments, air passage 104, e.g. the radial swirler, can contribute 40% to 50% of total air, while outer air passage 130 contributes 50% to 60% of the flow. By using a non-swirling outer air passage 130, the diameter of nozzle 100 can be reduced and extremely high swirl can be applied to core air flow in swirling air passage 104. However, while inner air passage 104 is described as a swirling air passage and outer air passage 130 is described as a non-swirling air passage, those skilled in the art will readily appreciate that this can be reversed, or both can be counter-swirled, or the like, as needed to provide a shear layer of air for atomization of the fuel exiting fuel circuit 106.

With continued reference to FIG. 2, outer air passage 130 is a converging non-swirling outer air passage 130. An annular outlet 132 of outer air passage 130 is proximate to a fuel circuit annular outlet 110. Fuel circuit 106 extends from a fuel circuit inlet 108, shown in FIG. 4, to a fuel circuit annular outlet 110. Fuel circuit 106 includes a plurality of helical passages 112 to add resistance to fuel flow before exit, thereby mitigating gravitational effects at low fuel flow rates. Traditional fuel distributors tend to drool, e.g. fuel tends to pool at one end, when exposed to similar low flow rates. Starting points for helical passages 112 are spaced apart circumferentially. It is contemplated that the axial distance between passages ranges from 0.030 inches (0.762 mm) to 0.100 inches (2.54 mm). Those skilled in the art will readily appreciate that this distance depends partly on the width of each individual helical passage 112, which can range from between 0.025 inches (0.635 mm) to 0.05 inches (1.27 mm). The thread pitch for the plurality of helical passages 112, for example, nine passages of 0.035 inches (0.889 mm) wide, would be 0.405" (10.29 mm).

As shown in FIG. 2, the proximity of fuel circuit outlet 110 to swirling air passage 104 and results in an intense mixing being focused on a fuel film exiting from fuel circuit 106. The high co-swirling core air from air passage 104 is used to distribute swirling fuel from fuel circuit outlet 110 before mixing with unswirled air from outer air passage 130. Converging outer air from outer air passage 130 and diverging inner flow from air passage 104 squeeze the fuel film at an exit 117 of nozzle 100. This results in a very thin layer adjacent to the reacting zone such that the flame initially burns rich, but is very quickly quenched to pre-turbine temperature levels (T4), for example, the T4 temperature level for modern engines ranges from 2500 to 3500° F. (1371 to 1926° C.). This results in very hot, evenly distributed, stable temperatures near nozzle outlet 117, but low emissions due to the quick quench. The hot temperatures at the nozzle outlet 117 assist in stabilizing reactions downstream in the thin mixing layer.

Those skilled in the art will readily appreciate that the converging layer of unswirled air exiting from outlet air passage 130 is thinner than the diverging layer of swirling air exiting from inner air passage 104. Moreover, the fuel film exiting fuel circuit outlet 110 travels a very short distance to reach outlet 132 of outer air passage 130. Swirling air from air passage 104 continues to squeeze the fuel film downstream into the unswirled converging air layer from outer air passage 130 for an axial distance measured from nozzle outlet 117 of approximately one-half of the diameter of nozzle 100. It is contemplated that the thin layer of unswirled converging air and the thin fuel film exiting from fuel circuit 106 lead to very rapid mixing of hot reacted gases, fuel and fresh air. Those skilled in the art will readily appreciate that this is different from a premixer since a hot flame zone exists.

As shown in FIG. 3, each helical passage 112 of fuel circuit 106 opens tangentially with respect to fuel circuit annular outlet 110 into an outlet 114 of air passage 104. Fuel flow exiting fuel circuit 106 exits from outlet 110 at an extremely large tangential angle, for example, the angle can range from 75 to 88 degrees. Those skilled in the art will readily appreciate that the angle can vary depending on the number of helical passages 112. The radial pressure gradient resulting therefrom helps to reduce film thickness at annular outlet 110. Each helical passage 112 intersects a single cross-sectional plane taken along longitudinal axis A, for example the cross-sections shown in FIGS. 2 and 3. Multiple helical passages 112 intersect each cross-sectional plane taken along longitudinal axis A. Each of helical passages 112 complete at least one 360 degree pass around fuel circuit 106. Helical passages 112 are defined by helical threads 113 in a fuel circuit outer wall 116.

Figure 4:
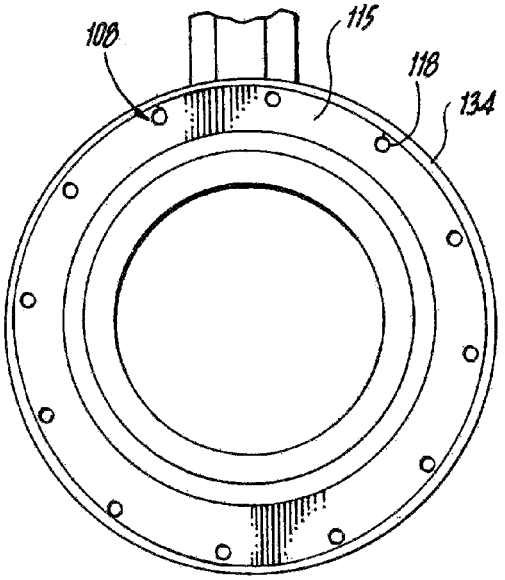
FIG. 4 is an upstream elevation view of a portion of the nozzle of FIG. 1, showing the circumferentially spaced apart openings of the fuel circuit inlet.

With reference now to FIGS. 3 and 4, fuel circuit inlet 108 includes a plurality of circumferentially spaced apart openings 118 in fluid communication with a fuel manifold 120. Those skilled in the art will readily appreciate that while fuel manifold 120 is shown integrally formed with backing plate 124, it can be formed independent of backing plate 124.

Figure 5:
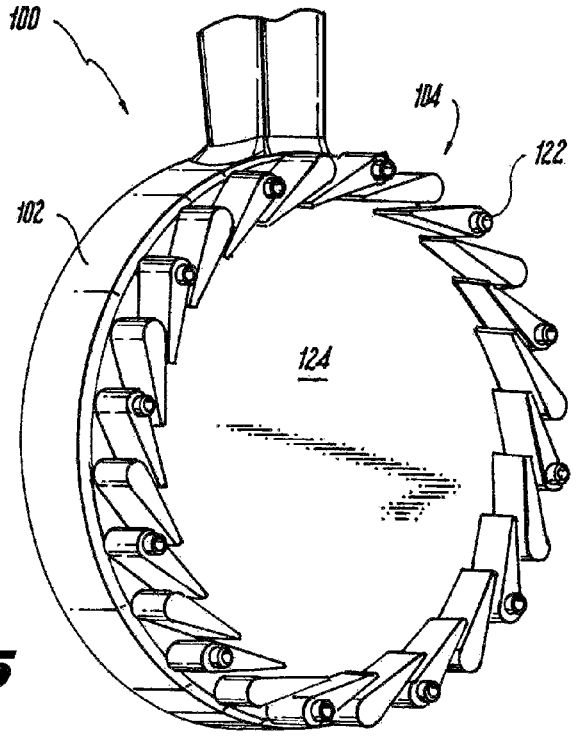
FIG. 5 is a perspective view of a portion of the nozzle of FIG. 1, showing the vanes of the air passage.

As shown in FIGS. 2 and 5, a plurality of cylindrical tubes 122 are defined through air passage 104. Each tube 122 connects a respective opening 118 to fuel manifold 122. Tubes 122 can be metallic transfer tubes. It is also contemplated that in place of some of tubes 122, fasteners can also be used. Vanes, described above, can be hollow and/or ceramic, and are used to insulate tubes 122 as they pass through air passage.

Figure 6A:
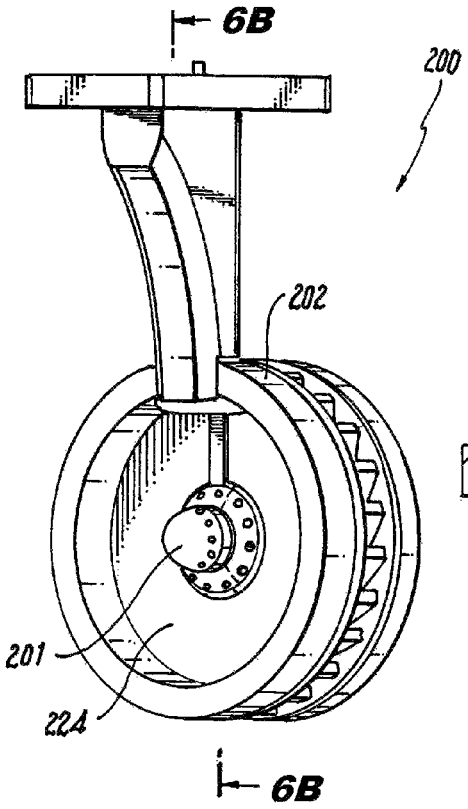
FIG. 6A is a perspective view of another exemplary embodiment of a nozzle constructed in accordance with the present disclosure, showing a low-flow fuel nozzle integrated into the backing plate.
Figure 6B:
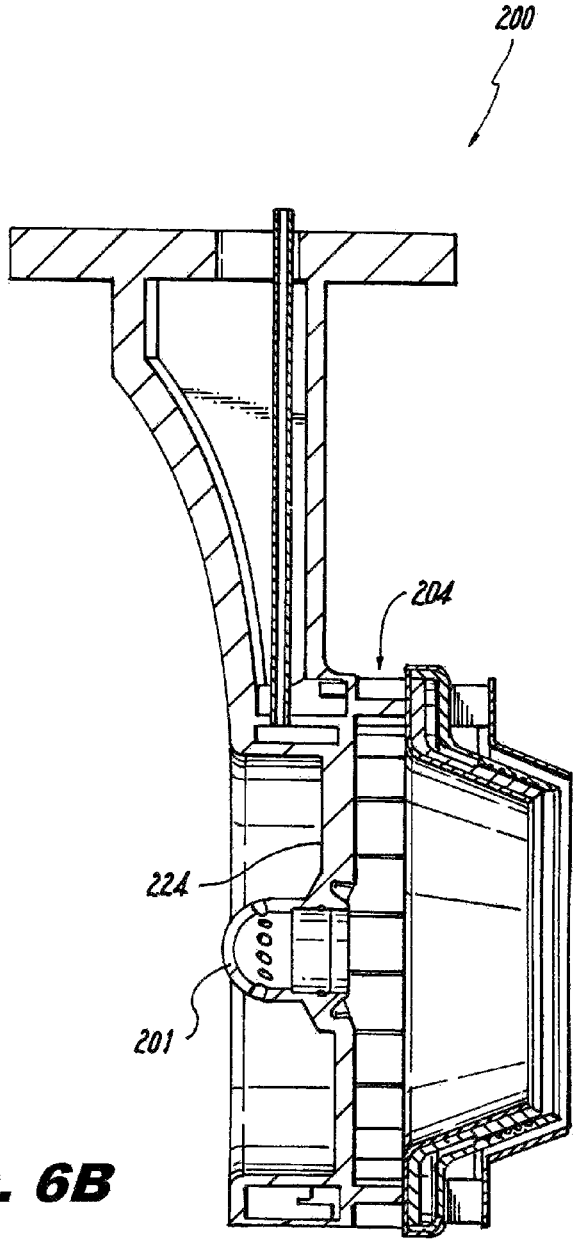
FIG. 6B is a cross-sectional side elevation view of the nozzle of FIG. 5, showing the corresponding cross-section indicated in FIG. 6A.

As shown in FIGS. 6A and 6B, nozzle 200 is similar to nozzle 100. Nozzle 200 includes a low-flow fuel nozzle 201 integrated into a backing plate 224 of nozzle body 202 upstream from air passage 204. Those skilled in the art will readily appreciate that this will assist with fuel staging, if required.

Those skilled in the art will readily appreciate that embodiments of the present invention, e.g. nozzles 100 and 200, are easily manufactured radial swirlers that are lightweight. Nozzles 100 and 200 can be additively manufactured, for example using direct metal laser sintering, or the like. Moreover, components of nozzle body 102 and 202 can be appropriately spaced to permit thermal expansion and contraction. Additionally, annular fuel outlet 110, with very limited exposure to the hot surface of air passage 104 outlet 114, eliminates backflow and flashback possibility that tends to exist if fuel is introduced too early into core.

The methods and systems of the present disclosure, as described above and shown in the drawings provide for radial swirl nozzles with superior properties including reduced emissions and improved temperature uniformity. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A nozzle, comprising:

a nozzle body defining a longitudinal axis including:

an air passage having a radial swirler and a converging conical cross-section;

an annular fuel manifold upstream of the radial swirler and surrounding the air passage; and a fuel circuit radially outboard from the air passage with respect to the longitudinal axis, the fuel circuit extending from a fuel circuit inlet to a fuel circuit annular outlet, wherein the fuel circuit includes a plurality of helical passages to mitigate gravitational effects at low fuel flow rates, wherein the plurality of helical passages are located downstream of the radial swirler and are in fluid communication with the annular fuel manifold, and each of the plurality of helical passages of the fuel circuit opens tangentially with respect to the fuel circuit annular outlet into an outlet of the air passage.

2. The nozzle as recited in claim 1, wherein each of the plurality of helical passages intersects a single cross-sectional plane taken along the longitudinal axis.

3. The nozzle as recited in claim 1, wherein more than one of the plurality of helical passages intersect each cross-sectional plane taken along the longitudinal axis.

4. The nozzle as recited in claim 1, wherein each of the plurality of helical passages completes at least one 360 degree pass through the fuel circuit.

5. The nozzle as recited in claim 1, wherein the plurality of helical passages are defined by helical threads in at least one of a fuel circuit inner wall or a fuel circuit outer wall.

6. The nozzle as recited in claim 1, wherein the fuel circuit annular outlet is proximate to the outlet of the air passage.

7. The nozzle as recited in claim 1, wherein the fuel circuit is defined between a fuel circuit inner wall and a fuel circuit outer wall, wherein at least a portion of the fuel circuit outer wall is radially outboard from the fuel circuit inner wall with respect to the longitudinal axis, and wherein at least a portion of both the fuel circuit inner wall and outer wall are conical shapes that converge toward the longitudinal axis.

8. The nozzle as recited in claim 1, wherein the fuel circuit inlet includes a plurality of circumferentially spaced apart openings in fluid communication with the annular fuel manifold.

9. The nozzle as recited in claim 8, wherein the nozzle body includes a plurality of tubes defined through the air passage, each tube of the plurality of tubes connecting a respective one of the plurality of circumferentially spaced apart openings to the annular fuel manifold.

10. The nozzle as recited in claim 9, wherein the air passage includes an annular inlet, and wherein the radial swirler includes radial swirl vanes circumferentially spaced apart from one another about the annular inlet, wherein the plurality of tubes are defined within the radial swirl vanes.

11. The nozzle as recited in claim 1, wherein the air passage is defined between a backing plate and a fuel circuit inner wall downstream from the backing plate, wherein at least a portion of the fuel circuit inner wall is a conical shape that converges toward the longitudinal axis.

12. The nozzle as recited in claim 1, wherein the air passage includes an annular inlet, and wherein the radial swirler includes radial swirl vanes circumferentially spaced apart from one another about the annular inlet to induce swirl into air entering the annular inlet.

13. The nozzle as recited in claim 1, wherein the nozzle body includes an insulation jacket between the air passage and the fuel circuit.

14. The nozzle as recited in claim 1, wherein the nozzle body includes an outer air passage defined radially outboard of the fuel circuit with respect to the longitudinal axis.

15. The nozzle as recited in claim 14, wherein the outer air passage is defined between a fuel circuit outer wall and an outer air passage wall, and wherein the outer air passage is a converging non-swirling outer air passage.

* * * * *